US006883294B2

(12) United States Patent
Reist

(10) Patent No.: US 6,883,294 B2
(45) Date of Patent: Apr. 26, 2005

(54) METHOD AND DEVICE FOR THE PACKAGING OF FLAT OBJECTS

(75) Inventor: Walter Reist, Hinwil (CH)

(73) Assignee: Ferag AG, Hinwil (CH)

( * ) Notice: Subject to any disclaimer, the term of this patent is extended or adjusted under 35 U.S.C. 154(b) by 0 days.

(21) Appl. No.: 10/719,902

(22) Filed: Nov. 21, 2003

(65) Prior Publication Data

US 2004/0112014 A1 Jun. 17, 2004

(30) Foreign Application Priority Data

Nov. 29, 2002 (CH) ..... 2014/02

(51) Int. Cl.[7] ..... B65B 43/04

(52) U.S. Cl. ..... 53/455; 53/450; 53/453; 53/459; 53/476; 53/559; 53/562; 53/574

(58) Field of Search ..... 53/559, 562, 570, 53/574, 578, 579, 437, 444, 476, 479, 480, 453, 455, 459, 469, 284.7, 450, 547; 156/515, 583.1, 583.4, 583.5

(56) References Cited

U.S. PATENT DOCUMENTS

| | | | | | |
|---|---|---|---|---|---|
| 3,838,631 | A | * | 10/1974 | Simpson et al. | 493/194 |
| 3,901,754 | A | * | 8/1975 | Simpson et al. | 156/251 |
| 3,951,399 | A | | 4/1976 | Reist | |
| 3,971,299 | A | * | 7/1976 | Whittle et al. | 493/196 |
| 4,115,183 | A | * | 9/1978 | Achelpohl et al. | 156/515 |
| 4,331,502 | A | * | 5/1982 | Achelpohl et al. | 156/515 |
| 4,586,703 | A | | 5/1986 | McAnelly | |
| 5,042,230 | A | * | 8/1991 | Petersen | 53/452 |
| 5,062,825 | A | * | 11/1991 | Smith et al. | 493/194 |
| 5,108,085 | A | * | 4/1992 | Smith et al. | 271/276 |
| 5,845,463 | A | * | 12/1998 | Henaux | 53/450 |

FOREIGN PATENT DOCUMENTS

| | | |
|---|---|---|
| DE | 38 38 985 C1 | 11/1989 |
| EP | 0 588 764 A2 | 8/1993 |
| EP | 0 753 386 B1 | 5/1996 |
| EP | 1 188 670 A1 | 8/2001 |
| GB | 973639 | 10/1964 |

* cited by examiner

*Primary Examiner*—Louis Huynh
*Assistant Examiner*—Hemant M. Desai
(74) *Attorney, Agent, or Firm*—Rankin, Hill, Porter & Clark LLP

(57) ABSTRACT

For packaging flat objects (4) using a packaging material (7) being supplied as a quasi-endless web, a string of bags (7') being open on three sides and closed on one side is continuously formed and conveyed in a conveying direction. During conveyance the bags (7') are each charged with at least one object (4), are severed from each other, and are then sealed with seams corresponding with the open bag sides. The depth of the bags during the step of forming the string of bags (7') and/or the distance between the two lateral seams during the step of sealing are adjusted to the format of the object to be packaged (4), or to the width of the packaging material (7), respectively. For being able to restrict adjustability to a forming device (7') and to a sealing device (7'), the bags are conveyed such that their open side opposite the one closed side and the corresponding seam keep a position that is independent of the format of the objects to be packaged (4) at all stages of procedure, and the bags are secured in the region of this open side.

14 Claims, 6 Drawing Sheets

METHOD AND DEVICE FOR THE PACKAGING OF FLAT OBJECTS

BACKGROUND OF THE INVENTION

1. Field of the Invention

The present invention generally relates to the field of the packaging technology and concerns a method and a device for packaging of flat objects with the aid of a packaging material that is supplied as a quasi-endless web and, more particularly, toward such a method and device wherein the packaging material is a web of a weldable plastic film or sheet material supplied from a supply reel.

2. Description of Related Art

A known method for continuously packaging individual printing products or small batches of printing products using a web of a plastic film or sheet material supplied from a reel comprises guiding a product stream, in which the products to be packaged are oriented parallel to the conveying direction and are conveyed behind each other and spaced from one another, between two webs of the packaging material, or joining the product stream with one web and then wrapping the web round the products or round the stream respectively. Then the web or webs of film material are sealed parallel to the conveying direction, and they are sealed and separated in the gaps between the products, i.e. transverse to the conveying direction. Such a method and a device for carrying out the method are described in the publication EP-1188670.

Packaging methods as mentioned above reach their limits regarding performance in produced packages per time unit relatively soon, because the products are conveyed parallel to the conveying direction and behind each other. For high performance, particularly in the case of products being relatively long in conveying direction, the above-mentioned methods lead to conveying speeds that are not easily achieved.

Higher piece performances at easily achieved conveying speeds are known to be possible if the products are conveyed in a conveying stream in which they are not aligned parallel to the conveying direction but rather essentially transverse to the conveying direction. The publication EP-0588764 (Grapha Holding AG) describes a device that is apparently suitable for packaging products being supplied in such a manner. The device comprises a processing drum of the kind used for inserting supplements into printing products or into folded sheets of packaging material. The plastic web is drawn from a supply point at the drum periphery in a zig-zag motion into the compartments of the drum, which are arranged in succession around the circumference of the drum. The bags thus formed are then charged with products, separated, and sealed, and the completely packaged products are removed from the drum compartments.

In the publication DE-3838985 (MAN) an equivalent device for batch-wise operation is described in more detail. With the aid of this device the plastic film web supplied from the supply reel is spread out in a zig-zag, creating a predetermined number of V-shaped bags that are open along three edges and in which the products to be packaged are positioned. Then the bags are separated, closed around the product within, sealed along the three open edges, and discharged from the device. Not until then another given number of bags are formed and the procedure is repeated. For each bag to be fashioned in one batch, an essentially identical device-part is provided and all device-parts are operated simultaneously.

No proposals as to how the described devices, in particular the continuously operating devices, can be adapted to varying formats of the objects to be packaged are found in any of the aforementioned publications. Therefore, it is the object of the invention to tackle this very task. As long as this object is not achieved, either elaborate adjustments of the device are required as soon as objects with a differing format are to be packaged, or a separate device is necessary for each format, or else products with differing formats are packaged using the same package format, which leads to insufficiently adjusted packaging and presents a waste of packaging material, particularly in the case of large numbers of packages to be produced.

SUMMARY OF THE INVENTION

It is therefore the object of the invention to create a method and a device for packaging flat objects using a quasi endless web of packaging material, in particular a weldable plastic film or sheet material, wherein the objects are continuously conveyed during the packaging process and are aligned essentially transverse to the conveying direction. The method and device are to be as simple as possible and the packaging to be produced is to be easily adjustable to varying formats of the objects to be packaged.

The method according to the invention includes shaping the quasi-endless packaging material into a string of essentially V-shaped bags (i.e. arranging it in a zig-zag formation), the bags being open on three sides and closed on one side, wherein the bags are conveyed in the conveying direction. During conveyance, each bag is charged with a flat object or a small group of flat objects, is separated from the string of bags, and is then sealed with essentially three seams. At every stage of the procedure the position of the open bag side opposite the one closed bag side, or the middle seam of the three seems to be produced respectively, is independent of the format of the object to be packaged. The adjustment to the format of the objects to be packaged is achieved by fashioning bags of relevant depth on one hand, and by the use of packaging material of relevant width and an appropriate setting of the position of at least one of the two lateral seams. In some cases one or the other adjustment options can be omitted.

At least for the charging step, which relies at least partly on gravity, and advantageously also for the sealing step, the bags are conveyed with their open side opposite the one closed side facing upwards and are advantageously only fixed to the device in the region of this middle open side. Accordingly, the adjustment of the bag depth concerns only the step of forming the bags and all steps following the forming step therefore remain independent of the bag depth.

As at least the step of sealing the bags is performed in rotating conveying compartments, advantageously in appropriately equipped conveying compartments of a processing drum, it is possible with simple means to simultaneously adjust the position of the sealing means provided in each compartment in order to adjust the position of the lateral seams to the format of the objects to be packaged. In addition to the possibly required change of the packaging material (different web width) to be processed, the named adjustment is the only necessary adjustment in order to produce packages of different widths.

In addition to means for supplying and for discharging the objects and for supplying the packaging material, the device according to the invention further comprises: a means for forming from the web of packaging material a string of bags being open at three sides; a means for conveying the bags in the conveying direction; a means for separating bags from the string of bags; and a means for sealing the three open sides of the bags by producing appropriate seams. For the adjustment of the device to the format of the objects to be packaged, the means for forming the string of bags is adjustable for setting different bag depths and/or the means for sealing is adjustable for setting the different distances between the two lateral seams. All other means can be realized without adjustability to the format of the objects to be packaged.

The means for conveying the bags advantageously comprises a securing means for fixing or securing each bag in the region of its open side opposite the one closed side or in the region of the corresponding seam, respectively. The securing means is active at least for the step of inserting the object to be packaged into the bag, for the step of separating the bag from the string of bags, and for the sealing step. The means for conveying further comprises a plurality of rotating conveying compartments in which the bags are positioned at least for the sealing step, advantageously for all the steps of the packaging procedure.

A preferred embodiment of the device according to the invention is based on a drum with radial conveying compartments rotating around an essentially horizontal axis, wherein, for forming the string of bags, the packaging material is drawn into the conveying compartments, and wherein the compartments or the bags fashioned within, respectively, are then charged with objects to be packaged. If, for the step of filling, the conveying compartments are positioned such that the open bag side opposite the one closed bag side is facing upwards and the objects are inserted from above, it suffices to secure the bags to the conveying compartments in the region of this upper side only, and the adjustment of the bag depth does not affect a fixing means. The bottom of the bag is held in a defined position by the gravity of the objects and without a need for further fixing. All conveying compartments further comprise sealing elements that are moveable in relation to each other, which are equipped for making seams, and which are simultaneously adjustable to varying widths of the objects to be packaged and to varying widths of the web of packaging material, i.e. are able to be shifted transverse to the conveying direction and parallel to the drum axis.

By charging the conveying compartments with the objects to be packaged in the region of the upper zenith (12 o'clock position) of a processing drum and by supplying the packaging material just upstream of this zenith, the following further advantage is achieved: up to three quarters of the drum rotation are available for the sealing step and, if applicable, the separating step, and all the same, the packaged objects can still be discharged downwards from the conveying compartments, i.e. by gravity.

BRIEF DESCRIPTION OF THE DRAWINGS

Exemplary embodiments of the device according to the invention are described in detail in connection with the following drawings, wherein.

DETAILED DESCRIPTION OF THE PREFERRED EMBODIMENTS

Figure 1:
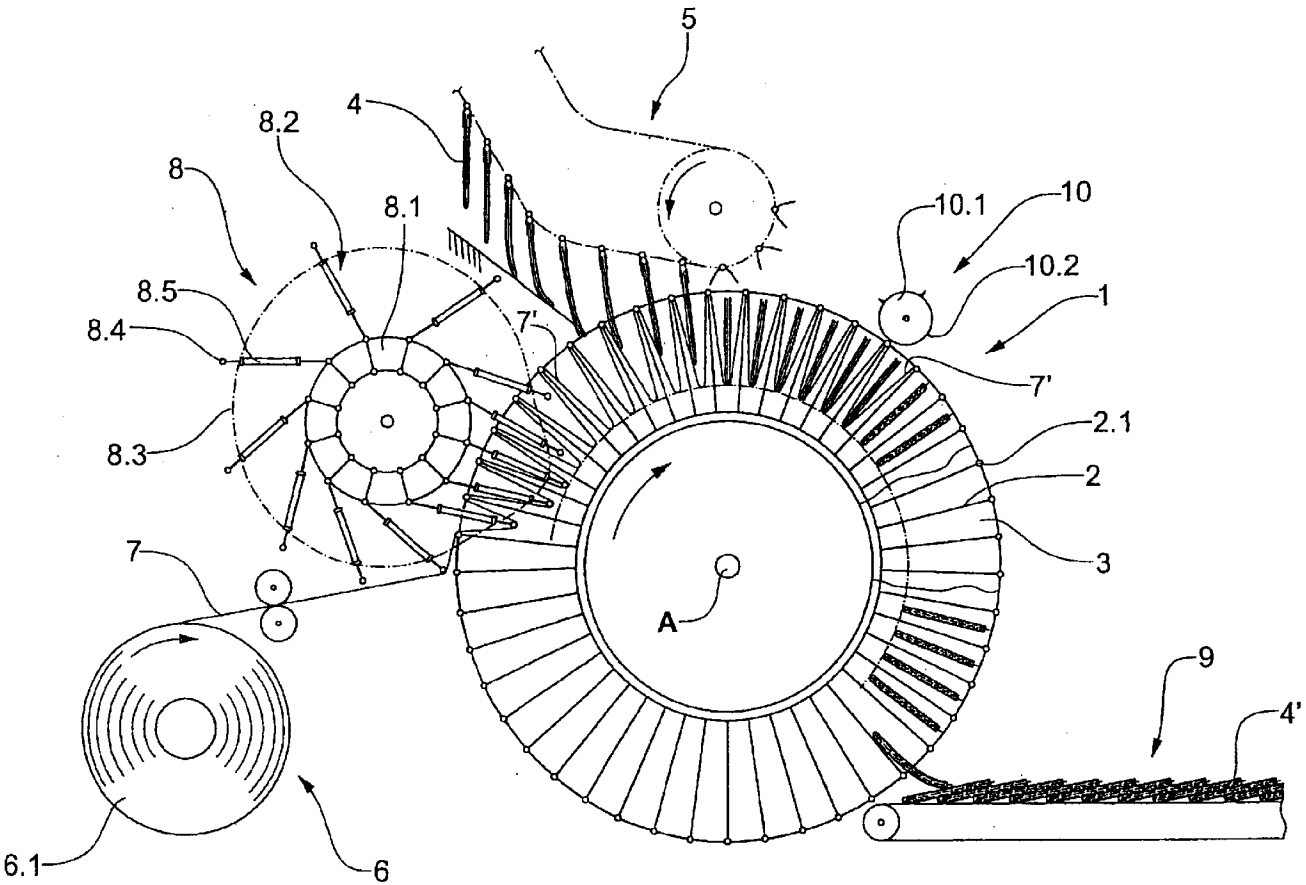
FIG. 1 is a schematic diagram of an exemplary embodiment of the device according to the invention, showing a drum with conveying compartments, wherein the bags are fashioned in the conveying compartments (viewing direction parallel to drum axis)

FIG. 1 illustrates the preferred embodiment of the device according to the invention which, as already mentioned further above, comprises a drum with conveying compartments, wherein these conveying compartments serve every step of the packaging procedure.

The drum 1 is driven to rotate around the essentially horizontal drum axis A and comprises conveying compartments 3 formed by compartment elements 2. Objects 4 are inserted into these conveying compartments 3 in a per se known manner, for example by a gripper chain transporter (means 5 for supplying objects to be packaged), in particular in an upper drum position so that gravity drives the objects as far as possible into the conveying compartments 3. The means 6 for supplying the quasi-endless web of packaging material 7 and downstream of the latter the means for drawing the web into the conveying compartments are both arranged upstream of the means for supplying the objects to be packaged. The means 9 for discharging the packaged objects 4' from the conveying compartments 3 to be conveyed away is arranged downstream of the means 5 for supplying the objects to be packaged. The device further comprises a severing means 10 arranged between the drawing-in means 8 and the discharging means 9 (upstream or downstream of the means for supplying the objects to be packaged).

The means 6 for supplying the quasi-endless web of packaging material 7 comprises, for example, a supply reel from which the packaging material is guided by suitable guide means (not illustrated) towards the drum periphery.

The means 8 for drawing the packaging material 7 into the conveying compartments is arranged at the periphery of the drum and comprises a number of drawing-in members 8.2 attached in an articulating manner to a rotating organ 8.1. The rotating organ 8.1 is driven in synchronism with the drum and the drawing-in members 8.2 are guided in a path (dash dot line 8.3) so that the distal end of one drawing-in member 8.2 sinks into each conveying compartment 3 passing the drawing-in means 8, thus drawing the packaging material 7 into the conveying compartment 3 to fashion a bag 7'. The distance between the rotating organ 8.1' and the distal end of the drawing-in member 8.2 determines the bag depth and is adjustable. To enable the packaging material 7 to glide across the distal ends of the drawing-in members 8.2 without hindrance, these distal ends are advantageously designed as freely rotating rolls 8.4. The rolls 8.4 extend parallel to the drum axis 8.5 at a length of at least the broadest width of the packaging material to be processed. The two roll ends are, for example, arranged on pivoting levers 8.5 having an adjustable length. The rotating organ 8.1 consists, for example, of two jointly driven, coaxial wheels, or of a pair of corresponding circulating chains, wherein each pivoting lever 8.5 of each drawing-in member 8.2 is connected to one of the named wheels or chains.

To enable the packaging material 7 to be drawn into the conveying compartments 3 by the drawing-in members 8.2 without hindrance, the distal ends of the compartment elements 2, across which the packaging material 7 is drawn, are, in a similar way as the distal ends of the drawing-in elements 8.2, advantageously equipped with freely rotating rolls 2.1 or with a rounded surface, across which the packaging material 7 can glide without much friction.

The discharging means 9 comprises a conveyor such as a conveyor belt and is advantageously arranged in the lower half of the drum periphery, so that the packaged objects 4' can be discharged from the conveying compartments 3 by gravity.

The severing means 10, which is arranged between the drawing-in means 8 and the means 5 for supplying the objects to be packaged, or immediately downstream of the latter, serves for severing the packaging material 7 where it stretches across the distal end of each compartment element 2, i.e. for severing individual bags 7' from the string of bags. The severing means 10 comprises a severing reel 10.1, extending parallel to the drum axis A, driven in synchronism with the drum, and comprising axial blades or heating wires 10.2 spaced at regular intervals around its circumference. The axis of the severing reel 10.1 is arranged such that the blades or heating wires 10.2 are able to sever the packaging material 7 running across the distal ends of the compartment elements 2.

A severing means 10 arranged outside the drum 1, as illustrated in FIG. 1, is advantageous only if the severing of the packaging material can be executed in a very short time. For severing methods requiring more time, the distal ends of the compartment elements 2 are advantageously equipped with a severing element, for example, with an axially-moving cutting element.

All conveying compartments 3 are further equipped with controllable fixing or securing elements, which are not shown in FIG. 1, and with controllable sealing elements, which are only shown very schematically in FIG. 1.

The securing elements are controlled such that securing the bags 7' in the conveying compartments begins when the drawing-in member 8.2 has reached its deepest position in the conveying compartment 3, and ends at the earliest when the bag 7' is held fast in the conveying compartment by the sealing elements. The securing elements act in the region of the opening of the conveying compartments 3, i.e. in the region of the distal ends of the compartment elements 2 (advantageously in this region only). The function of an exemplary embodiment of securing elements is described in connection with FIGS. 4 and 5.

The sealing elements, which are able to be moved between an open and a closed position in relation to each other, are arranged in the conveying compartments 3 and are controlled such that they are moved into the closed position when a conveying compartment 3 is charged with an object 4 and the bag 7' positioned within the compartment is severed from the string of bags. The sealing elements are retracted into the open position at the latest when the packaged object 4' is to be discharged from the conveying compartment. The sealing elements act on the bag 7' positioned in a conveying compartment 3 in sealing it around the object positioned inside the bag at least in the region of the opening of the conveying compartment, though advantageously on all three sides on which the bag is open. To this end the two parts of the bag are pressed together beside the object and for sealing the packaging material by welding, e.g. heat or ultra-sound energy is applied simultaneously to all pressure points, or for sealing the packaging material by embossing the pressure points comprise embossing patterns. The sealing of the axially extending bag side (middle open bag side) is executed at a height in the conveying compartment that is independent on the format of the object. The sealing of the radially extending bag sides (lateral open bag sides) is adjusted to the width of the object to be packaged, or of the packaging material used respectively, by axial displacement of at least part of the sealing elements. Two exemplary embodiments of sealing elements and their adjustment to various widths of objects, or of packaging material respectively, are described in connection with FIGS. 4 to 7.

From FIG. 1 it is obvious that by supplying the objects to be packaged in the region of the upper zenith of the processing drum and by supplying the packaging material immediately upstream thereof, a large part of the drum periphery is available for sealing the bags. For gaining even another quarter of drum rotation for the sealing step, it would be easily possible to shift the discharging means 9 from its position shown in FIG. 1 to the left side of the drum. As in many cases, the sealing step determines the time necessary for a packaging cycle. This means that a processing drum used for the method according to the invention needs only a relatively small number of conveying compartments and/or can be driven at a relatively high speed.

Figures 2, 3:
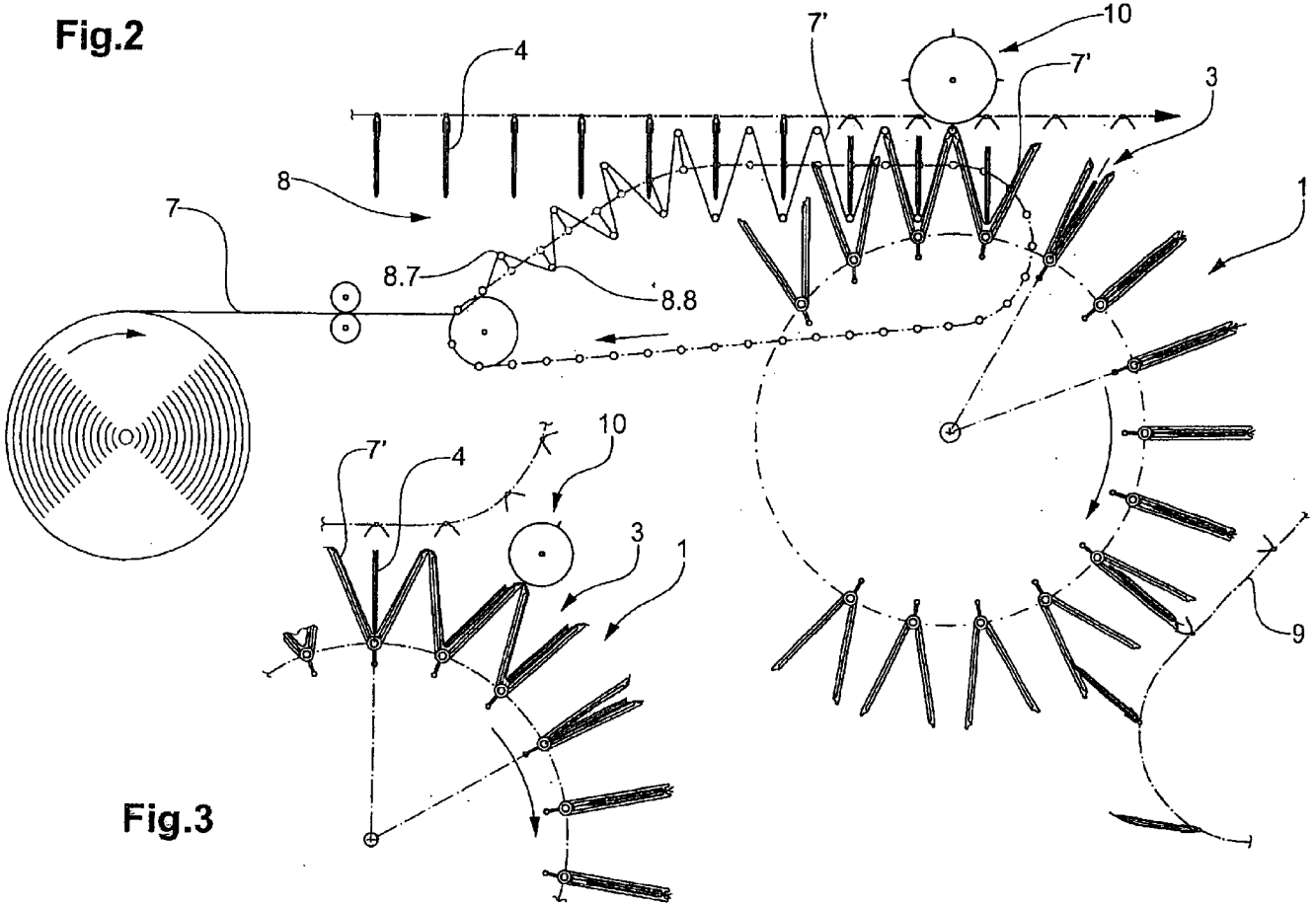
FIGS. 2 and 3 are schematic diagrams of further exemplary embodiments of the device according to the invention, which embodiments also comprise a drum with conveying compartments, wherein the bags are fashioned before being inserted into the conveying compartments, the conveying compartments therefore serving merely the step of sealing and, if applicable, the step of separating (viewing direction parallel to the drum axis)

FIG. 2 illustrates a further exemplary embodiment of the device according to the invention. In this embodiment, the drum 1 with conveying compartments 3 only serves the step of sealing the bags 7'. The steps of forming and charging the bags are at least partly performed outside the conveying compartments. Same elements are denominated with same reference numbers as in FIG. 1. The conveying compartments 3 of the drum 1 are reduced to sealing elements pivoting in relation to each other. The means 9 for discharging the packaged objects is designed as a gripper chain.

The means 8 for forming the string of bags from the quasi-endless web of packaging material 7 is a circulating system comprising guides 8.7 and 8.8 equipped to alternately guide the packaging material 7 from opposite sides thereof. The function of the guides 8.7 corresponds in the main with the function of the rolls 2.1. In FIG. 1, the function of the guides 8.8 with that of the drawing-in members 8.2 in FIG. 1. The string of bags is formed of the packaging material 7 independently of the, drum 1, by the alternating guides 8.7 and 8.8 being shifted with the packaging material relative to each other and transverse to the circulation direction, wherein the extent of this relative shift is adjustable to a depth of the bag corresponding with the format of the objects to be packaged. The path of the guides 8.7, which is defined by the circulation and the shifting, remains independent of format. As soon as the guides 8.7 and 8.8 have reached a position in which they have the largest distances between each other and the bags 7' thus formed are aligned with their open end opposite the one closed end essentially upwards, the guides 8.7 are brought into a securing configuration and the guides 8.8 are removed so that the objects 4 can be inserted into the bags 7'. The charged bags 7', still guided and secured by the guides 8.7, are brought into the conveying compartments 3 of the drum 1, and are sealed by the sealing elements arranged in these conveying compartments. As soon as the pressing means of the conveying compartments are active, the guides 8.7 can be withdrawn. The step of severing the string of bags into individual bags is carried out before or after the charging step, wherein the severing means 10 advantageously does not co-operate with the compartment elements of the processing drum as shown in FIG. 1 but with the guides 8.7.

The guides 8.7 and 8.8 are, for example, designed as freely rotating rollers or groups of rollers, wherein the rollers of guides 8.8 are entered or swung in over the web of packaging material (e.g. from the side). The guides 8.7 are equipped with, for example, pairs of rollers and comprising securing means arranged between the rollers (e.g. extendable rows of needles). The securing means are activated and de-activated in a controlled manner. Guides 8.7 may also comprise an element cooperating with the severing means (see FIG. 5).

FIG. 3 illustrates a further drum 1 that is applicable in the device according to FIG. 2. While, according to FIG. 2, the objects 4 are inserted into bags 7' held open by guides 8.7 and 8.8, according to FIG. 3 they are inserted between the sealing elements of the conveying compartments 3. The means 10 for severing the bags from the string of bags co-operates here with the sealing elements.

Figure 4:
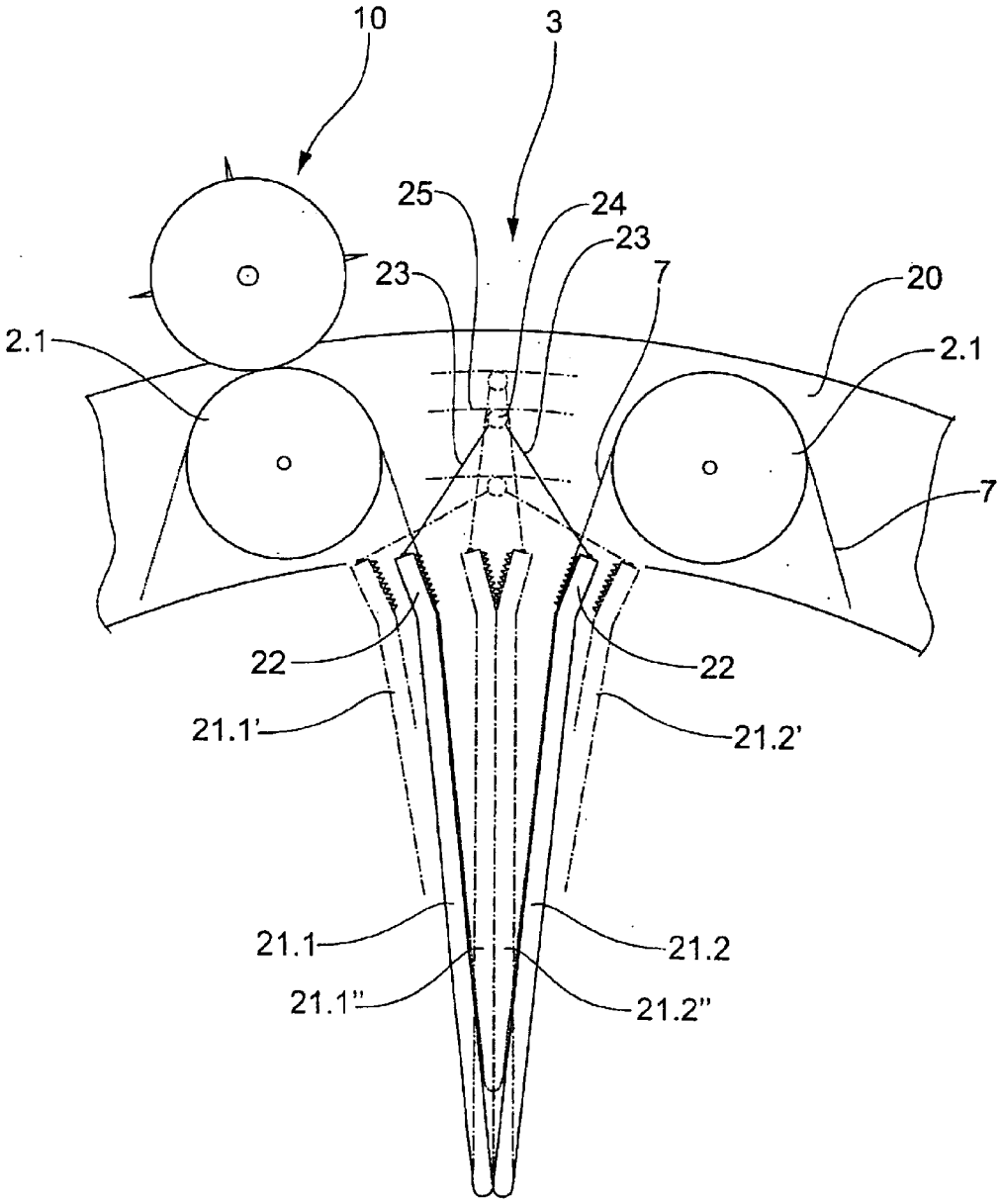
FIG. 4 shows an exemplary embodiment of the conveying compartment of the drum of the device according to FIG. 1 (viewing direction parallel to the drum axis)

FIG. 4 illustrates very schematically an exemplary embodiment of a conveying compartment 3 of the drum according to FIG. 1 (viewed parallel to drum axis). The opening of the conveying compartment 3 at the drum periphery is defined by two rollers 2.1 that are arranged between two rotating drive wheels 20 positioned at the drum faces and form the distal ends of the compartment elements. Attached to further, not illustrated, parts of the compartment elements and rotating with the drive wheels 20 and the rollers 2.1 are two sealing elements 21.1 and 21.2, which can be swivelled in relation to each other and can be held in a compressed position relative to each other by means (not shown). The distal ends of the sealing elements are further equipped with axially extending securing elements 22, such as rows of needles. The sealing elements 21.1 and 21.2 are shown in three positions: in a securing and open position, in which they secure the packaging material and are open for the insertion of the object to be packaged (drawn-out line and marked 21.1 and 21.2); in an inactive open position in which they do not secure the packaging material and therefore permit the packaging material to be drawn into the conveying compartment (dash dot lines and marked 21.1' and 21.2'); and in a securing and closed position (dash dot lines and marked 21.1" and 21.2") in which they are pressed against each other. For controlling the sealing elements 21.1 and 21.2, a pair of control levers 23 connected in an articulating manner to each other and to the distal ends of the sealing elements or the securing elements, respectively, are provided. The spread of the control levers 23, or the relative position of the sealing elements 21.1 and 21.2, respectively, is controlled by the control reel 24 and a correspondingly arranged stationary cam (indicated by line 25). The three positions of the sealing elements 21.1 and 21.2 are advantageously as near to each other as possible.

The sealing elements 21.1 and 21.2 have the particular task of sealing the two parts of the packaging material 7 placed on either side of the object around the object, during which process the packaging material remains secured by the fastening elements 22. For sealing a weldable packaging material, the sealing elements are equipped with one axial and two radial welding jaws that press and seal the packaging material protruding beyond the object to be packaged. The radial welding jaws are able to be shifted in an axial direction relative for their position to be adjusted to the width of the objects to be packaged.

An exemplary embodiment of such adjustable welding jaws is described in connection with FIG. 7. It is also possible to equip just the one sealing element with adjustable welding jaws and the other one as a counter surface that is broad enough for all the adjustment positions of the adjustable welding jaws.

The function of the conveying compartment according to FIG. 4 is, as already mentioned further above, the following: In the region of the supply of the packaging material, the sealing elements are in their inactive, open position 21.1' and 21.2'. As soon as the packaging material is drawn in, the sealing elements are swung into their securing open position 21.1 and 21.2. After charging the conveying compartments with objects to be packaged and after severing the packaging material (severing device 10), the sealing elements are brought into their securing and closed position 21.1" and 21.2" and sealing is performed by activating the welding jaws. FIG. 4 clearly shows that there is no need for any adjustment of the conveying compartment to varying bag depths.

Figure 5:
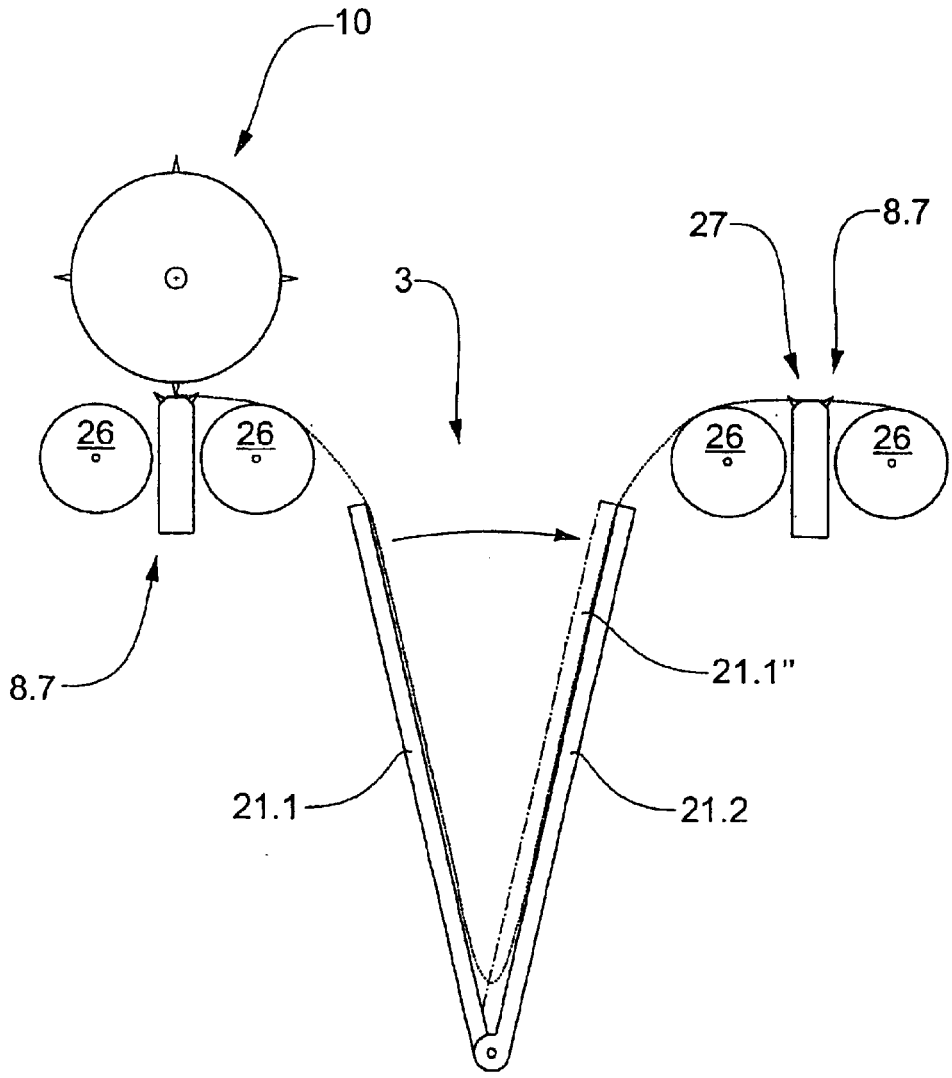
FIG. 5 shows an embodiment of the conveying compartment of the drum according to FIG. 2 in keeping with the embodiment according to FIG. 4 (viewing direction parallel to the drum axis)

FIG. 5 illustrates in an identical schematic manner as FIG. 4 a conveying compartment 3 of the drum according to FIG. 2, which conveying compartment cooperates with guides 8.7. Each guide 8.7 comprises a pair of rollers 26 as well as a securing element 27 (e.g. row of needles) arranged between the rollers 26 and comprising a severing sector (counter bearing for severing means 10) between two securing sectors. The components of the guides 8.7 are linked in a manner, not illustrated, enabling the securing element 27 to be moved in relation to the rollers 26 into an active (upper) and an inactive (lower) position. The guides 8.7 move (not illustrated) in synchronism with the conveying compartments during a part of their circulating movement and during such conveyance form the distal ends of the compartment elements. Of the conveying compartment 3, only the sealing elements 21.1 and 21.2 are shown in FIG. 3. The sealing element 21.2 keeps, for example, a position unaltered in relation to the guide 8.7 and thereby acts as a part of the conveying compartment. The sealing element 21.1 is pivoted into an open position and into a closed position adjacent to the sealing element 21.2. Control of the sealing elements 21.1 and 21.2 as illustrated in FIG. 4 is applicable if suitably adapted.

The guide 8.7 shown in FIG. 5 can also be employed instead of the rollers 2.1 in a device according to FIG. 1, in which case securing elements on the sealing elements are no longer necessary.

Figure 6:
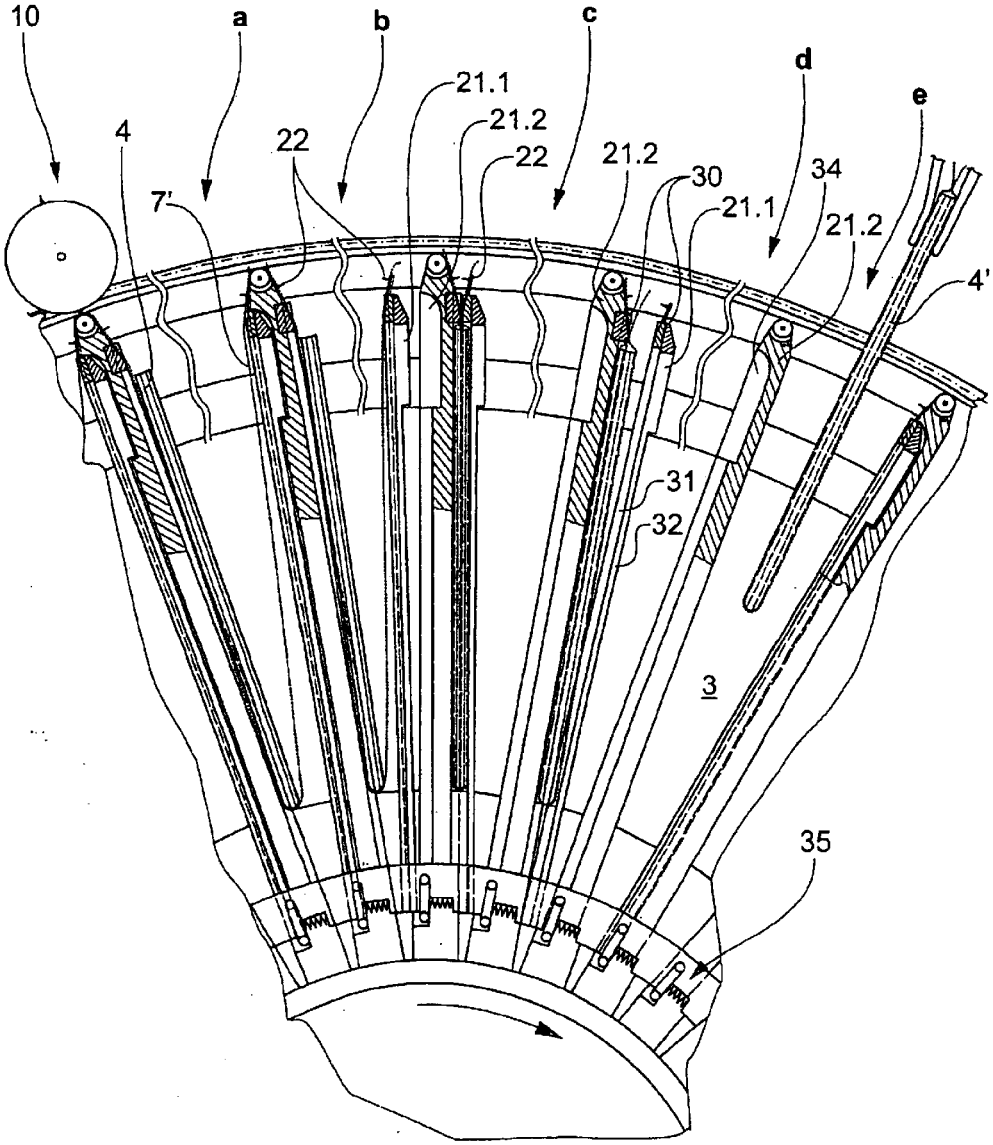
FIG. 6 shows a further embodiment of the conveying compartment of the drum according to FIG. 1 (cross section perpendicular to the drum axis); and, FIG. 7 shows the conveying compartment according to FIG. 6 (viewing direction perpendicular to the drum axis).
Figure 7:
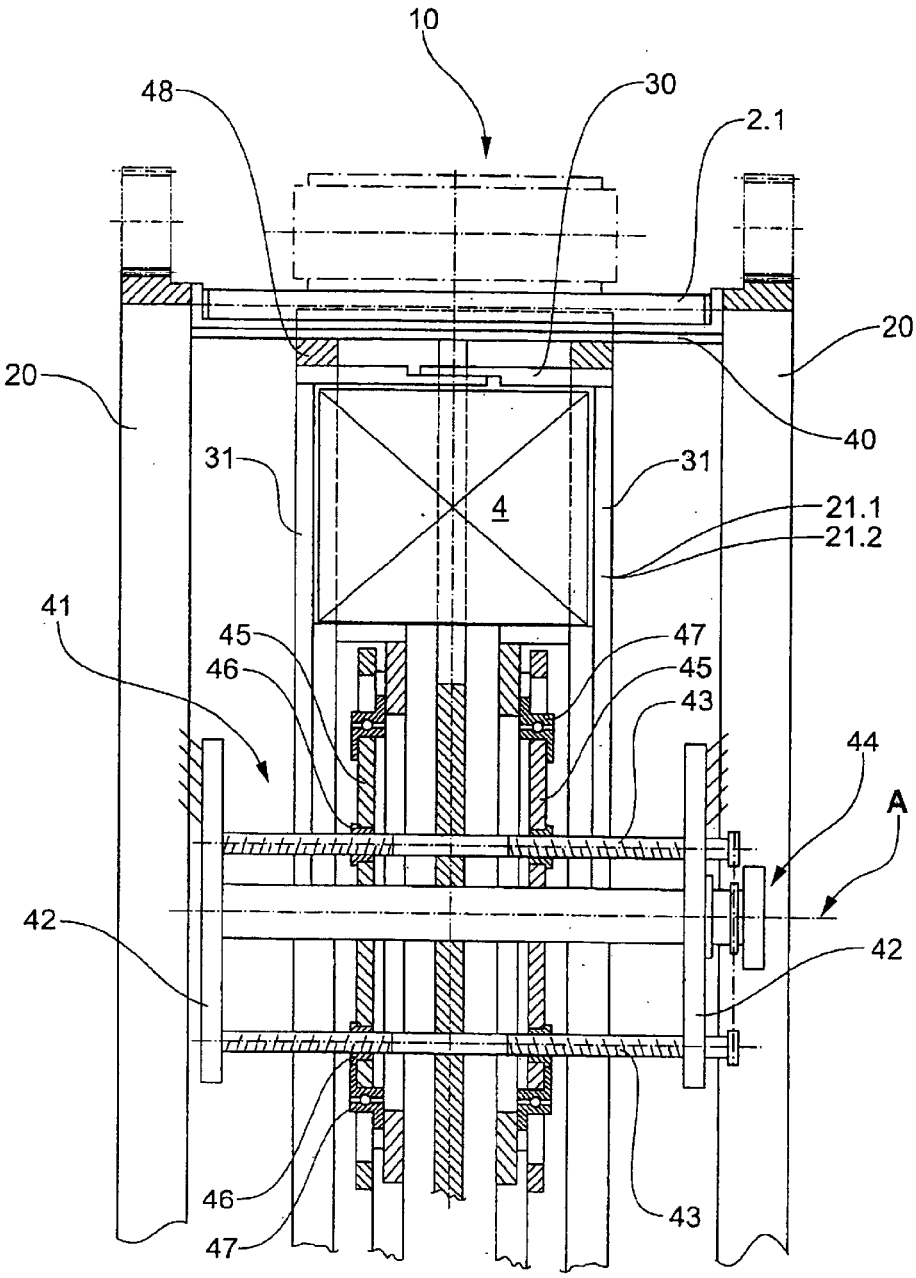

FIGS. 6 and 7 illustrate in a little more detail further exemplary embodiments of conveying compartments 3 of the drum according to FIG. 1. FIG. 6 shows a group of adjacent conveying compartments 3 in a cross section vertical to the drum axis and illustrates, in particular, the function of the elements of the conveying compartments. FIG. 7 shows an identical conveying compartment 3 in a cross section parallel to the drum axis and illustrates in particular the axial adjustability of the sealing elements. Functionally corresponding components are marked with the same reference numbers as in the previous drawings.

The conveying compartments according to FIGS. 6 and 7 differ from the conveying compartment of FIG. 4 in that one of the sealing elements (21.2) remains stationary in relation to the rollers 2.1 and the other one (21.1) is swivelled accordingly. Furthermore, the sealing elements 21.1 and 21.2 are shown to comprise axial welding jaws 30 and radial welding jaws 31 protruding towards each other and to further comprise central areas 32 supporting the object to be packaged. The stationary sealing element 21.2 comprises a depression 34 on its side facing the neighbouring conveying compartment 3 into which the pivoting sealing element 21.1 of this neighbouring conveying compartment is inserted when in its open position. Securing elements 22 are situated on both sides of the distal end of the stationary sealing element 21.2 and at the distal end of the pivoting sealing element 21.1. The securing elements 22 can be brought into an active and a passive configuration and are, for example, displaceable rows of needles.

The pivoting sealing elements 21.1 are advantageously attached to the base of the conveying compartments in a resilient manner (spring bearings 35).

The conveying compartments 3 illustrated in FIG. 6 and indicated from left to right by letters a to e are in the following configurations:

a The packaging material is drawn in and severed and forms a bag 7', the sealing element 21.1 is in its open position, the securing elements 22 are active, and the object to be packaged is positioned;

b The securing elements are still active, the sealing element is brought into its closed position;

c The securing elements are still active, the sealing element 21.1 is in its closed position, and the seams are being sealed;

d The bag 7' is sealed, the securing elements 22 are still active, the sealing element 21.1 is being brought into the open position;

e The securing elements 22 are passive, the sealing element 21.1 is in its open position, and the packaged object is being discharged.

FIG. 7 illustrates essentially the same conveying compartment as FIG. 6 (viewing direction perpendicular to the drum axis A, drum sectioned along axis A) and shows in particular an advantageous design of the axial adjustability of the sealing elements 21.1 and 21.2. FIG. 7 shows the drive wheels 20 on the faces of the drum, which drive wheels are driven by an external sprocket. The rollers 2.1 and the driving pins 40 extend between the drive wheels 20. Situated in the center of the drum is a stationary adjustment device 41 comprising two face plates 42 suitably fitted to the frame of the device, three threaded rods 43 carried in a rotatable manner by the face plates, and face side means 44 for synchronously rotating the threaded rods 43. The threaded rods comprise two regions of opposing threads; one to the left and the other one to the right side of the drum. Two adjustment plates 45 are attached to the threaded rods 43 by threaded nuts 46 so that they are pushed axially towards or away from each other when the threaded rods 43 are rotated. The two-part sealing elements 21.1 and 21.2, each equipped with one axial and two radial welding jaws, are displaced by the adjustment plates 45, and are rotated relative to the latter in the bearings 47. For being rotated with the drive wheels, the stationary sealing element 21.2 is suitably linked to the drive wheels 20, e.g. via the driving rings 48 and the driving pins 40.

The drum with the adjustment device 41, as illustrated in FIG. 7, is known to one skilled in the art from the publication EP-0753386 and therefore, does not need a more thorough description.

In the drum according to FIG. 7 the sealing elements are displaced symmetrically to a central plane of the drum, enabling the packaging material to always be supplied centrally to the drum, irrespective of its width. Of course, it is also possible to keep the position of the means for producing one side of the sealing unchanged and to only dislocate axially the means producing the sealing on the other side. In such a case the packaging material is to be supplied with one longitudinal edge having always the same position.

The adjustment device 41 of FIG. 7 is applicable correspondingly for adjusting elements of the conveying compartments according to FIGS. 4 and 5.

What is claimed is:

1. A method for packaging flat objects (4), the method comprising the steps of:

continuously forming a quasi-endless web of a packaging material (7) into a string of bags (7') the bags of said string are formed into rotating conveying compartments (3), or are formed outside of said compartments and are then supplied to said compartments, each bag of said string of bags having three open sides and one closed side, wherein the three open sides comprise an opposite open side, opposite to the one closed side, and two lateral open sides, conveying the string of bags in a conveying direction, during conveyance, charging each of the bags (7') with at least one flat object (4), severing the bags (7') from the string of bags, and sealing the bags (7') by seams corresponding to the open bag sides, wherein, during all method steps, the opposite open side and a corresponding seam keep a position that is independent of a format of the object to be packaged (4), wherein, at least one of a depth of the bags (7'), in the step of forming the string of bags, and a distance between two seams corresponding to the lateral open sides of the bag, in the step of sealing the bags, are adjusted to one of the format of the object to be packaged (4) or to the width of the packaging material respectively, and wherein the bags (7') are sealed while positioned in the conveying compartments (3) rotating in the conveying direction, wherein the bags (7') are formed in or supplied to the conveying compartments (3) and wherein the bags are charged with the objects to be packaged (4) in the conveying compartments (3) or before the bags are supplied to the conveying compartments (3).

2. The method according to claim 1, wherein the bags (7') are charged from above through the opposite open side opposite the one closed side and are secured in an area of said opposite open side from before the steps of charging and severing to the step of sealing.

3. The method according to claim 1, comprising the further steps of drawing the packaging material (7) to be formed into a string of bags into the rotating conveying compartments (3) by a plurality of drawing-in members (8.2), and, in the conveying compartment (3), securing each fully formed bag (7') in a region of its opposite open side, and then withdrawing the drawing-in member (8.2) from the bag, wherein a length of the drawing-in member (8.2) determines the depth of the bag (7').

4. The method according to claim 1, comprising the further steps of forming the string of bags from the packaging material (7) by guides (8.7, 8.8) acting alternately from either side of the packaging material, said guides (8.7, 8.8) being driven to move in the conveying direction and to be spaced, relative to each other transverse to the conveying direction, a distance adjusted to the depth of the bags to be formed, and securing the bags (7') to alternate guides (8.7), charging the bags with objects (4) and positioning the bags in rotating conveying compartments (3) for sealing.

5. The method according to claim 1, wherein the packaging material (7) is a weldable plastic foil or sheet material and wherein sealing of the bags is accomplished by welding.

6. A device for packaging flat objects (4) using a packaging material (7) in the shape of a quasi-endless web, the device comprising:

means (5, 9) for supplying objects to be packaged (4) and for removing packaged objects (4'), means (6) for supplying the packaging material (7), means for forming, from the packaging material (7), a string of bags (7') compartments (3), each bag of said string of bags having three open sides and one closed, wherein the three open sides comprise an opposite open side, opposite to the one closed side, and two lateral sides, means for conveying the bags (7') in a conveying direction, means for severing the bags (7') from the string of bags, and means for sealing the open sides of the bags (7') by producing appropriate seams, wherein the means for forming the bags (7') and the means for conveying the bags (7') are arranged such that the opposite open side a corresponding seam keep an unchanged position independent of the format of the object to be packaged (4), wherein at least one of the means for forming the string of bags (7'), which adjusts a depth of the bags, and the means for sealing the bags (7'), which adjusts a distance between two lateral seams, is adjustable, and wherein the means for forming the string of bags (7') comprises drawing-in members (8.2) of an adjustable length and cooperating with distal ends of rotating compartment elements (2), and wherein the securing elements (22) are arranged in the conveying compartments (3) formed by the compartment elements (2).

7. The device according to claim 6, wherein the means for conveying the bags (7') is designed and arranged such that, at least at a point of supply of the objects to be packaged (4), the bags (7') are positioned with their opposite open side facing upwards, and wherein the conveying means is equipped with securing elements (22, 27) for securing the bags (7') in the region of said opposite open side.

8. The device according to claim 6, wherein distal ends of the rotating compartment elements (2) and of the drawing-in members (2.1) comprise freely rotating rollers (2.1).

9. A device for packaging flat objects (4) using a packaging material (7) in the shape of a quasi-endless web, the device comprising:

means (5, 9) for supplying objects to be packaged (4) and for removing packaged objects (4'), means (6) for supplying the packaging material (7), means for forming, from the packaging material (7), a string of bags (7') that have three open sides and one closed side, wherein the three open sides comprise an opposite open side, opposite to the one closed side, and two lateral sides, means for conveying the bags (7') in a conveying direction, means for severing the bags (7') from the string of bags, and means for sealing the open sides of the bags (7') by producing appropriate seams, wherein the means for forming the bags (7') and the means for conveying the bags (7') are arranged such that the opposite open side and a corresponding seam keep an unchanged position independent of the format of the object to be packaged (4), wherein at least one of the means for forming the string of bags (7'), which adjusts a depth of the bags, and the means for sealing the bags (7'), which adjusts a distance between two lateral seams, is adjustable, wherein the means for forming the string of bags (7') comprises circulating guides (8.7, 8.8), wherein the guides are adapted to alternately act from two opposing sides of the packaging material (7) and to be displaced relative to each other and transversely to a circulation direction, and wherein each alternate guide (8.7) is equipped with securing elements (27).

10. The device according to claim 9, wherein a circulation path of the guides (8.7) is aligned with a rotation path of the conveying compartments (3) such that the guides (8.7) are conveyed along a part of their path in a region of the distal ends of the compartment elements (2) that form the conveying compartments (3).

11. A device for packaging flat objects (4) using a packaging material (7) in the shape of a quasi-endless web, the device comprising:

means (5, 9) for supplying objects to be packaged (4) and for removing packaged objects (4'), means (6) for supplying the packaging material (7), means for forming, from the packaging material (7), a string of bags (7') wherein the bags of said string are formed into continuously rotating conveying compartments (3), or are formed outside of said compartments and are then supplied to said compartments, each bag of said string of bags having three open sides and one closed side, wherein the three open sides comprise an opposite open side, opposite to the one closed side, and two lateral sides, means for conveying the bags (7') in a conveying direction, means for severing the bags (7') from the string of bags, and means for sealing the open sides of the bags (7') by producing appropriate seams, wherein the means for forming the bags (7') and the means for conveying the bags (7') are arranged such that the opposite open side and a corresponding seam keep an unchanged position independent of the format of the object to be packaged (4), wherein at least one of the means for forming the string of bags (7'), which adjusts a depth of the bags, and the means for sealing the bags (7'), which adjusts a distance between two lateral seams, is adjustable, wherein the rotating conveying compartments (3) are equipped with sealing elements (21.1, 21.2) that are moveable against each other in a controlled manner, wherein the sealing elements (21.1, 21.2) are adapted to produce three seams corresponding with the open sides of the bags, and wherein at least some of the sealing elements (21.1, 21.2) of each said conveying compartment are simultaneously adjustable to various distances between lateral seams.

12. The device according to claim 11, wherein the conveying compartments (3) are positioned in a drum (1) that is rotatable around a drum axis (A).

13. The device according to claim 12, wherein the drum (1) comprises a centrally arranged adjustment device (41), said adjustment device being adapted to simultaneously adjust the sealing elements (21.1, 21.2) of all the conveying compartments (3).

14. The device according to claim 12, wherein the means (5) for supplying the objects (4) is arranged in the region of an upper zenith of the drum (1), the means for supplying the packaging material (7) or the string of bags is immediately upstream of the means (5) for supplying the objects (4), and the means (9) for discharging the packaged objects (4') are arranged in a lower region of the drum (1).

* * * * *

UNITED STATES PATENT AND TRADEMARK OFFICE

CERTIFICATE OF CORRECTION

PATENT NO. : 6,883,294 B2
DATED : April 26, 2005
INVENTOR(S) : Reist

It is certified that error appears in the above-identified patent and that said Letters Patent is hereby corrected as shown below:

Column 10,
Line 45, after "(7)", insert -- into rotating conveying --.
Line 46, after "closed", insert -- side --.
Line 58, after "side", insert -- and --.

Column 11,
Line 22, delete "that have" and insert
-- and supplying said bags into rotating conveying compartments (3), each bag of said string of bags having --.

Signed and Sealed this

Ninth Day of August, 2005

JON W. DUDAS
*Director of the United States Patent and Trademark Office*